US012805628B2

(12) United States Patent
Kim

(10) Patent No.: US 12,805,628 B2
(45) Date of Patent: Nov. 24, 2026

(54) HAIRBRUSH APPLICATOR AND HAIRBRUSH DISPENSER CONFIGURATIONS

(71) Applicant: Michelle Kim, San Francisco, CA (US)

(72) Inventor: Michelle Kim, San Francisco, CA (US)

( * ) Notice: Subject to any disclaimer, the term of this patent is extended or adjusted under 35 U.S.C. 154(b) by 42 days.

(21) Appl. No.: 18/592,673

(22) Filed: Mar. 1, 2024

(65) Prior Publication Data

US 2025/0275624 A1 Sep. 4, 2025

(51) Int. Cl.

| | |
|---|---|
| ***A46B 11/00*** | (2006.01) |
| ***A45D 34/04*** | (2006.01) |
| ***A46B 7/04*** | (2006.01) |
| ***A46B 9/02*** | (2006.01) |
| ***A46B 9/06*** | (2006.01) |
| ***A46D 1/00*** | (2006.01) |

(52) U.S. Cl.

CPC ..... *A46B 11/0086* (2013.01); *A45D 34/042* (2013.01); *A46B 7/04* (2013.01); *A46B 9/023* (2013.01); *A46B 9/06* (2013.01); *A46B 11/0065* (2013.01); *A46D 1/02* (2013.01); *A46B 2200/104* (2013.01)

(58) Field of Classification Search

CPC ..... A46B 11/0086; A46B 7/04; A46B 9/023; A46B 9/06; A46B 11/0065

See application file for complete search history.

(56) References Cited

U.S. PATENT DOCUMENTS

| | | | | | |
|---|---|---|---|---|---|
| 1,763,832 | A * | 6/1930 | Taylor | A46B 11/0013 | 401/281 |
| 2,238,603 | A * | 4/1941 | Runnels | A46B 7/044 | 132/142 |
| 6,098,233 | A * | 8/2000 | Chen | A46B 7/04 | 601/138 |
| 8,277,139 | B1 * | 10/2012 | Deans | A46B 11/0013 | 401/281 |
| 9,364,067 | B2 * | 6/2016 | Pham | A45D 19/026 | |
| D918,468 | S * | 5/2021 | Kim | D28/7 | |
| D930,366 | S * | 9/2021 | Kim | D4/127 | |

(Continued)

OTHER PUBLICATIONS

European Search Report dated Jul. 19, 2024 in European Application No. 24162306.5.

*Primary Examiner* — Nicholas D Lucchesi
(74) *Attorney, Agent, or Firm* — Conley Rose, P.C.; John P. Teresinski

(57) ABSTRACT

Configurations are provided for hairbrush applicators and personal care devices, including dispensing and application of material to a user, such as powders and dry shampoo. According to embodiments, a hairbrush applicator includes a bristle assembly having bristles and a base tray, the base tray including at least one channel opening. The hairbrush applicator includes an applicator base configured to receive the bristle assembly and at least one flow hole to provide material to the bristles. The applicator base includes a rim with a guide channel, a collar is configured to engage with the rim and the guide channel. The collar can rotate relative to the applicator base to provide at least one position to dispense material to the bristle assembly. The applicator base may be configured to engage with a storage container configured to store material dispensed by the applicator which may include a disposable cartridge.

19 Claims, 8 Drawing Sheets

(56) References Cited

U.S. PATENT DOCUMENTS

| | | | | |
|---|---|---|---|---|
| 2009/0041530 | A1* | 2/2009 | Deans | A45D 33/02<br>401/268 |
| 2021/0345764 | A1 | 11/2021 | Kim | |
| 2022/0232946 | A1 | 7/2022 | Cui | |

* cited by examiner

HAIRBRUSH APPLICATOR AND HAIRBRUSH DISPENSER CONFIGURATIONS

FIELD

The present disclosure generally relates to personal care products including hairbrushes and cosmetic applicators, and more particularly to applicator elements and configurations.

BACKGROUND

Personal care products are produced in many configurations for various forms of self-care and a wide array of uses. Hairbrushes, for example, come in many designs and configurations for styling and brushing hair. Hairbrushes and combs often include a handle and arrangement of tines to brush hair. Despite various existing hairbrush configurations and cosmetic products in general, there exists a need for haircare products that assist with application of products to hair. By way of example, dry shampoo applicators can include pads for receiving product. These products often do not allow for proper application and can result in too much product being applied to a user. Other products include aerosol sprays. Due to byproducts of the spray, there exists a desire to reduce the use of aerosol products including spray on dry shampoos and spray on products. Aerosol sprays also may output an excess amount of material resulting in too much product being applied to a user. Application of an aerosol spray may also result in unwanted material being sprayed on a user's face, clothes, and surrounding areas. There exists a need which reduces the use of aerosol sprays and minimizes waste of personal care products.

There exists a need for applying product in a targeted way so as to apply powder in desired amounts and areas. There exists a need for applying product in a way that is easily distributed without the need for using a brush or comb to get the powder dispersed through the hair after powder application (or simultaneously). There exists a need for separating the hair strands while applying powder so that the powder can be dispersed evenly. There exists a need for limiting the powder from coming into contact with the scalp so that the powder does not cause scalp itchiness, clogged pores, or have to be washed out after each use. There exists a need for compact, travel-friendly, applicator that doesn't require the use of flammable liquids for passing TSA regulations. There also exists a need for products and designs to allow for application of dry shampoo and personal care products.

BRIEF SUMMARY OF THE EMBODIMENTS

Disclosed and described herein are configurations for hairbrush applicators and personal care applicators. According to embodiments, a hairbrush applicator configuration is provided including a bristle assembly including a plurality of bristles and a base tray, wherein the plurality of bristles are secured to the base tray, and wherein the base tray includes at least one channel opening. The hairbrush applicator configuration includes an applicator base configured to receive the bristle assembly, the applicator base including a body element having at least one flow hole, wherein the at least one flow hole is configured to provide material to the bristle assembly, wherein the applicator base includes a rim including at least one guide channel. The hairbrush applicator configuration includes a collar configured to engage with the rim, wherein the collar is configured to engage with the at least one guide channel, and wherein the collar is configured to rotate relative to the applicator base to provide at least a first position and a second position, wherein the second position is configured to arrange the at least one channel opening of the base tray and the at least one flow hole of the body element to dispense material to the bristle assembly.

According to embodiments, the plurality of bristles includes a first set of bristles including an arrangement of fiber elements, and a second set of bristles including a plurality of bristles each having a shaft and molded tip.

According to embodiments, the plurality of bristles are grafted to the base tray.

According to embodiments, the collar includes at least one tab protruding from an inner surface of the collar, the at least one tab configured to engage with the at least one guide channel.

According to embodiments, the base tray of the bristle assembly includes at least one notch and the collar includes at least one protrusion configured to engage with the at least one notch of the base tray, and wherein the collar is configured to rotate the bristle assembly to align of the collar the at least one channel opening with the at least one flow hole.

According to embodiments, the collar is configured to rotate within the same plane of the at least one guide channel, wherein the first position is configured as an off position, an intermediate position of the collar is a first flow setting, and the second position of the collar is a second flow setting, wherein the second flow setting provides increased flow of material relative to the first position.

According to embodiments, the body element of the applicator base includes a plurality of flow holes having a first opening size, and a plurality of flow holes having a second opening size, wherein the second opening size is greater than the first opening size.

According to embodiments, the applicator base includes a notch opening for each of the first position and the second position, and a slot between the first and the second position.

According to embodiments, the applicator base is configured to engage with a storage container, the storage container including a compartment configured to store material dispensed by the applicator.

According to embodiments, the applicator base and collar form a handle for the hairbrush applicator, and the bristle assembly is configured to apply at least one of dry shampoo and powder to user hair.

Embodiments are also directed to a hairbrush applicator including a storage container. The hairbrush applicator includes a bristle assembly including a plurality of bristles and a base tray, wherein the plurality of bristles are secured to the base tray, and wherein the base tray includes at least one channel opening. The hairbrush applicator includes a storage container including a compartment configured to store material dispensed by the hairbrush applicator. The hairbrush applicator includes an applicator base configured to receive the bristle assembly, the applicator base including a body element having at least one flow hole, wherein the at least one flow hole is configured to provide material to the bristle assembly, wherein the applicator base includes a rim including at least one guide channel. The hairbrush applicator includes a collar configured to engage with the rim, wherein the collar is configured to engage with the at least one guide channel, and wherein the collar is configured to rotate relative to the applicator base to provide at least a first position and a second position, wherein the second position is configured to arrange the at least one channel opening of the base tray and the at least one flow hole of the body element to dispense material to the bristle assembly.

According to embodiments, the applicator base, storage container and collar form a handle for the hairbrush applicator, and the bristle assembly is configured to apply at least one of dry shampoo and powder to user hair.

According to embodiments, the storage container is configured to receive and retain a removable cartridge including the material to dispense to the bristle assembly.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 1A:
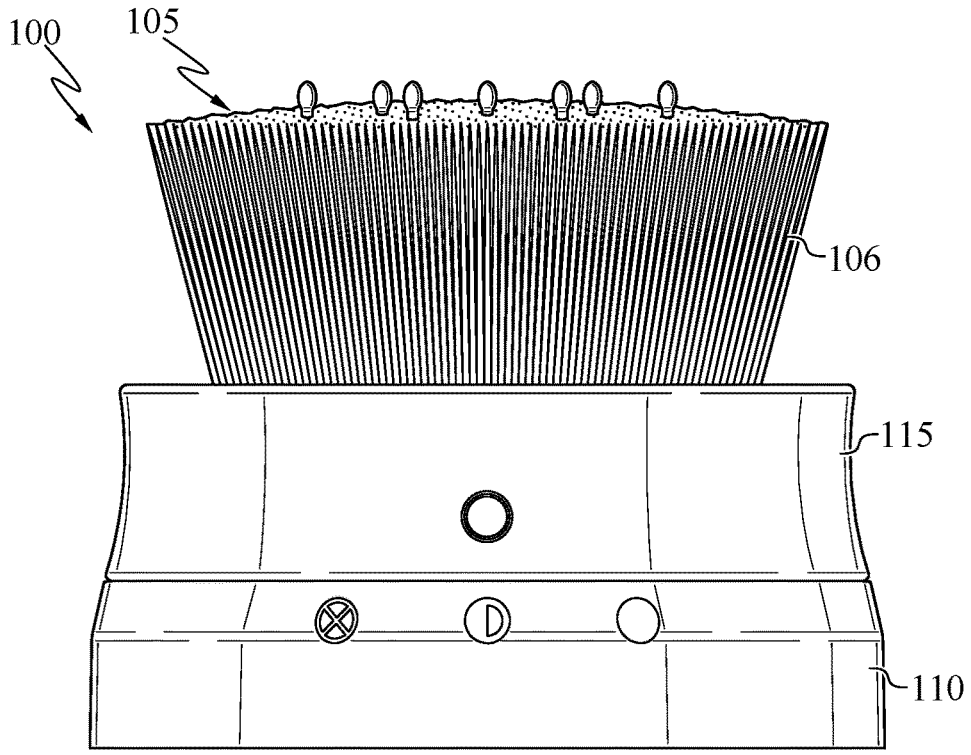
FIGS. 1A-1C illustrate a hairbrush applicator according to one or more embodiments.

Embodiments of the disclosure are directed to configurations for personal care products including hairbrush applicators and dry shampoo brushes. According to embodiments, configurations provide features for application of a product or material to a user, such as a powder, dry shampoo or personal care product in general. Embodiments provide configurations that allow for a plurality of flow control settings and a brush configuration to evenly distribute material to a user's hair. By controlling flow of material, users can evenly distribute products and limit and/or avoid waste of a product. In addition, hairbrush applicators may use products that do not require aerosol sprays for application of a product.

Haircare products, such as dry shampoo, may be used to boost texture and volume of hair. Dry or powder products may be difficult to apply for some users. Embodiments provide configurations that include hairbrush applicators that are fast acting and easy to use. Configurations can limit and/or eliminate residue. In addition to application of dry shampoo material to a user hair, such as a user scalp, hairbrush applicators as described herein may include one or more features to clean and remove oil from a user's hair. By way of example, hairbrush applicators may be used to apply product to a user's hair, distribute the product by using the hairbrush application to brush hair and removal oil from a user's hair or scalp. Hairbrush applicators according to embodiments may also be used for leave in products.

According to embodiments, a hairbrush applicator may include a bristle assembly and one or more structural elements. Structural elements may allow for the hairbrush applicator to be attached to one or more styles of container, such as a powder or dry shampoo container. In addition, structural elements may allow for providing a configuration that allows for one or more positions for controlling flow of material to bristles, such as first setting as an "off" position, a second setting to allow for an "on" position and one or more intermediary positions One or more positions may provide a level of flow control. Structural elements of hairbrush applicators according to embodiments, allow for a compact design, a recyclable product and configurations that allow for dispensing and retaining material.

According to embodiments, a hairbrush applicator may include bristles and structural elements that control the flow of material to bristles. According to embodiments, hairbrush applicator configurations may include a container coupled to one or more structural elements of the hairbrush applicator. Embodiments describe configurations for containers and use of disposable or refillable cartridges. It should be appreciated that hairbrush applicators may be used with one or more container configurations.

According to embodiments, a hairbrush applicator may include a bristle assembly, an applicator base, and a collar. The applicator base may be configured to receive and/or support the bristle assembly, and the collar may be configured to be coupled to the applicator base. The collar and the applicator base may retain the bristle assembly, and rotation of the collar may result in one or more flow holes of the applicator base and channels of the bristle assembly to be aligned. By aligning openings in the applicator base and bristle assembly, material may flow from the applicator base to bristles of the bristle assembly. According to embodiments, flow control may be provided by a plurality of openings, such as flow holes in an applicator base. An applicator base may include one or more sets or groups of flow openings. Configurations may include one or more structural elements to align flow holes.

According to embodiments, hairbrush applicators may be configured to use one or more refills, capsules, pouches and/or cartridges. Embodiments provide solutions for user action to pour or refill loose material in a container. Alternatively, or in addition, embodiments provide solutions that reduce the amount of material needed and material that may be wasted after use. By way of example, a hairbrush applicator configuration may be configured to receive a pouch or cartridge or material that is sealed, and which may use less packaging than a replacement container. Replaceable cartridges or pouches may be an inner cartridge or container that includes a leak protection seal that allows for transport/shipping and which may be removed in full, or in part, prior to use with a hairbrush applicator.

Embodiments provide solutions for application of products including dry shampoo and powder materials. According to embodiments, configurations include one or more elements to apply product in a targeted way, such as applying powder in desired amounts and areas, and for applying product that is easily distributed without the need for using a separate brush or comb to get the powder dispersed through the hair after powder application. Embodiments provide elements configured to separate hair strands while applying powder so that the powder can be dispersed evenly. In addition, embodiments provide configurations for limiting powder from coming into contact with the scalp so that the powder does not cause scalp itchiness, clogged pores, or have to be washed out after each use. Embodiments also provide compact, travel-friendly, applicators that do not require the use of flammable liquids for passing TSA regulations.

It should be appreciated that embodiments are not limited to personal care products or hairbrush applicators and may be used and/or applied in other spaces. By way of example, embodiments may provide configurations for one or more of a scalp applicator, scalp massager, dry shampoo brush, haircare product dispenser, hairbrush bristles, brushes in general and other personal care devices. Similarly, embodiments may provide configurations for application of one or more of powders, personal care products, minerals, mineral mixtures and other types of material.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1B:
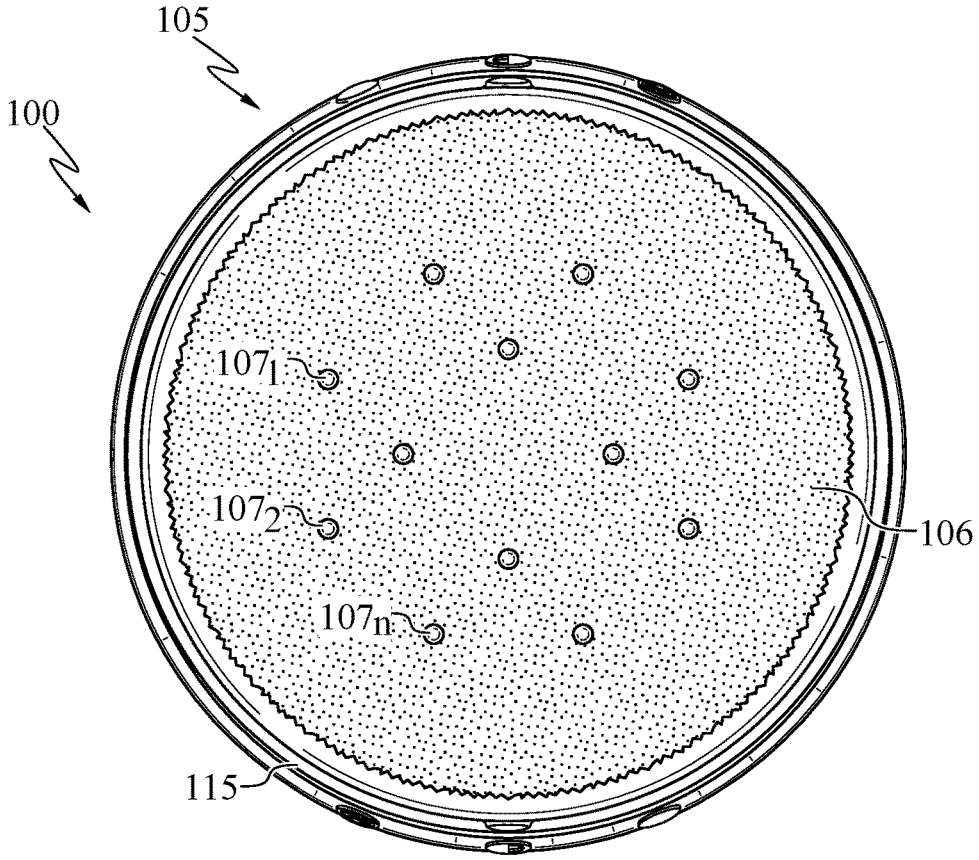
Figure 1C:
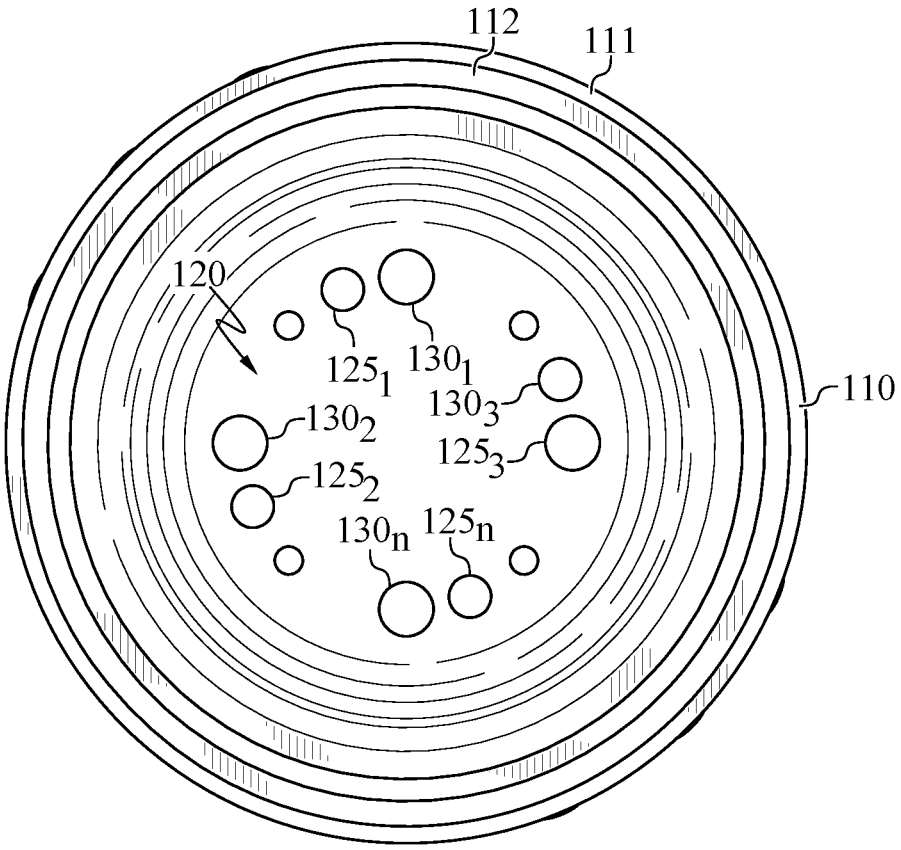

FIGS. 1A-1C illustrate hairbrush applicator 100 according to one or more embodiments. FIG. 1A shows a side-profile view of hairbrush applicator 100 including bristle assembly 105, applicator base 110 and collar 115. According to embodiments, hairbrush applicator 100 may be configured to apply material, such as a powder, dry shampoo, personal care product in general, to a user. Hairbrush applicator 100 includes structural features which allow for control and dispensing material which are not provided by conventional devices. Similarly hairbrush applicator 100 may include one or more positions or settings that allow for different operation relative to existing devices. In addition, hairbrush applicator 100 includes a design and configuration that reduces the amount of plastic used to form the device. Moreover, hairbrush applicator 100 includes a design and configuration that allows for improved manufacturing by decreasing the need for injection molding.

According to embodiments, hairbrush applicator 100 is an applicator for one or more personal care products, the products may be applied by way of bristle assembly 105. Bristle assembly 105 may include at least one set of bristles, such as bristles 106. One or more components of hairbrush applicator 105 may allow for material to be dispensed or released to bristle assembly 105 and bristle assembly 105 may be used as a brush to apply product dispensed to bristles to a user. By way of example, for a powder or dry shampoo, product may be released to bristles 106 of bristle assembly 105 and bristles 106 may be used to brush a user's hair and/or scalp. Portions of hairbrush applicator 105 may be used as a handle, such as one or more of collar 115 and applicator base 110. Portions of hairbrush applicator 105, such as one or more of collar 115 and applicator base 110, may be used to adjust the rate material is dispensed or released to bristles 106. According to embodiments, collar 115 may rotate relative to applicator base 110 from a first position (e.g., off position) to at least one of an intermediate position (e.g., light flow) and a second position (e.g., regular, heavy or increased flow). According to embodiments, rotation of collar 115 to one or more positions may be settings for dispensing material. In addition, each rotation position may relate to one or more of a size and amount or flow holes or channels for material to flow or pass through to bristles 106. Hairbrush applicator 100 may include one or more elements to allow for collar 115 to be rotated relative to applicator base 110 and to allow collar 115 to be coupled to applicator base 110.

According to embodiments, hairbrush applicator 100 is a cap or topper for at least one of a container or storage element. Applicator base 110 may be configured to secure hairbrush applicator to the container. Coupling of an applicator base to a container is shown and described herein below with reference to FIGS. 2A-2B. According to embodiments, when hair brush applicator 100 is in an open position, material such as dry shampoo or other personal care products may be dispensed from the container to bristle assembly 105 by inverting or turning over the hairbrush applicator. Material may be dispensed while using the hairbrush applicator. For example, a user may hold the hairbrush applicator in a position, such as an inverted, angled or tilted position to use bristle assembly 105 to brush the user's hair. Material dispensed to the bristle assembly and/or in the container may be applied to the user's hair and/or scalp. Although embodiments of hairbrush applicator 100 are described as applying dry shampoo, it should be appreciated that other types of material may be dispensed and for other personal care purposes and applications in general.

Figure 4A:
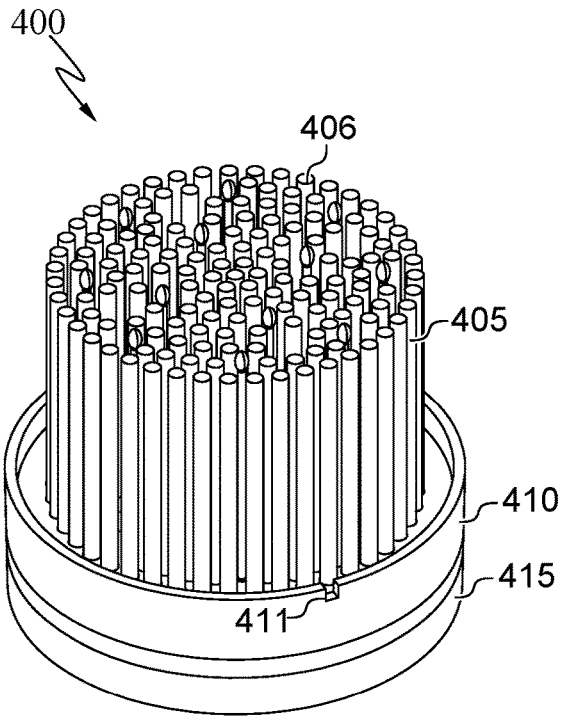
FIGS. 4A-4B illustrate a hairbrush applicator bristle assembly according to one or more embodiments.
Figure 4B:
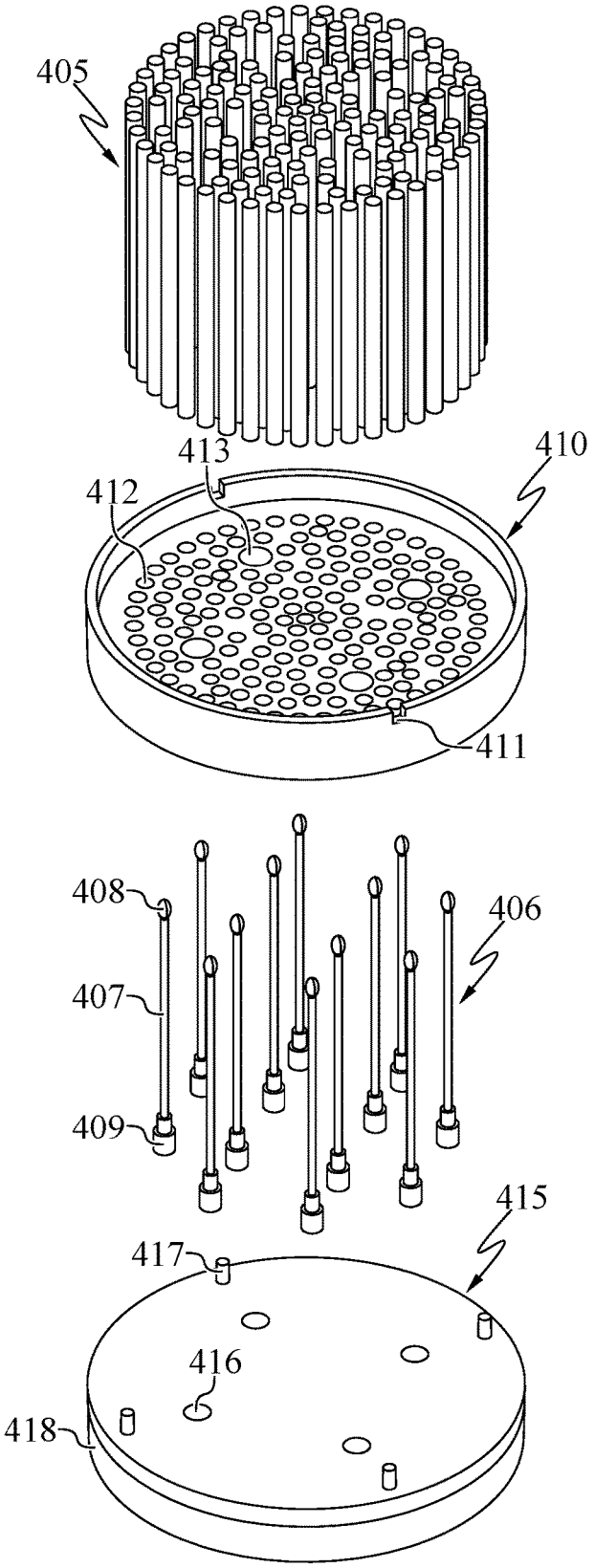

According to embodiments, bristle assembly 105 includes a plurality of bristles, including bristles 106, and at least one structural element, such as a base tray securing the bristles. Bristles may be mounted in the structural element such that bristles are secured and allow for material to pass throw one or more channel openings in the base tray to bristles 106. Bristles 106 may be fibers similar to hairs. Bristles 106 may be densely packed and stand upright. Bristle assembly 105 may include rigid and/or soft bristles used in hair care for smoothing, styling, and detangling human hair, or for grooming. Bristles assembly 105 may limit material, such as powder, from coming into contact with a user's scalp so that the powder does not settle into the pores causing adverse reactions like scalp itchiness, clogged pores, or temporary hair loss. Bristles assembly 105 may include a second set of bristles including a shaft portion and molded end. According to embodiments, bristle assembly 105 may be received and/or supported by applicator base 110. A structural element, such as a base tray, may be received by a support surface of applicator base 110. According to embodiments, collar 115 may interface with applicator base 110 to secure bristle assembly 105. As such, collar 115 and applicator base 110 may retain bristle assembly 105. FIGS. 4A-4B illustrate features of bristles assemble 105 according to one or more embodiments.

FIG. 1B illustrates a plan view of hairbrush applicator 100 including bristle assembly 105 and collar 115. According to embodiments, bristle assembly 105 includes a first set of bristles, bristles 106 including an arrangement of fiber elements. Bristle assembly 105 includes a second set of bristles 1071-*n*. Bristles 1071-*n* may each include a plurality of bristles each having a shaft and molded tip. According to embodiments, bristles 1071-*n* include a pattern or arrangement of bristles in a two, four, four, two pattern that includes a row of two bristles, two rows of four bristles and a row of two bristles as shown in FIG. 1B with respect to the bottom to top of the bristle assembly 105. Bristles 106 may be soft or fiber type bristles to gently apply material to user hair, distribute material to user hair and remove excess material from user hair. Bristles 1071-*n* may be formed of plastic or other harder material relative to bristles 106, and bristles 1071-*n* may be used to brush user hair and/or massage scalp. Bristles 106 and bristles 1071-*n* may each be grafted and/or inserted to a base tray of bristle assembly 105.

FIG. 1C illustrates a bottom view (e.g., under side) of hairbrush applicator 100 including applicator base 110. According to embodiments, applicator base 110 is configured to receive a container and/or material. Applicator base 110 may include at least one of threads 111 and a seal 112 (e.g., gasket) to couple to a container. Threads may allow for coupling by way of rotation and/or snap connection to a container. Seal 112 may be a rubber gasket or seal in general to allow for at least one of an engagement and to prevent leakage of material. Applicator base 115 may include body element 120 having at least one flow hole configured to provide material to a bristle assembly. Applicator base 110 may include a plurality of flow holes and the flow holes may be in a pattern. According to embodiments, body element 120 includes a first set of flow holes 1251-*n* and a second set of flow holes 1301-*n*. First set of flow holes 1251-*n* may be a first size and second set of flow holes 1301-*n* may be a second size, such as a large size to allow for increased flow and/or release of material. According to embodiments, flow holes 1251-*n* and 1301-*n* may be arranged in a circular pattern such that rotation of a collar (e.g., collar 110) may align one of surface of body element 120, flow holes 1251-*n* and 1301-*n* with channel openings of a bristle assembly. By rotating collar 115, bristle assembly 105 may be rotated and the flow holes in body element 120 allow for material to be dispensed and/or released to bristles of a hairbrush applicator. Setting or rotating to a first set of flow holes may allow for a setting, such as a light flow, and rotating to a second setting may allow for a high or regular flow of material. Positions of collar 115 may be secured and/or retained by one or more features of applicator base 110. Applicator base 110 is shown in more detail below in FIGS. 5A-5C. Applicator base 110 may include a rim on a top side (not shown in FIG. 1C) including at least one guide channel allows for controlling rotation positions of collar 110.

Figure 2A:
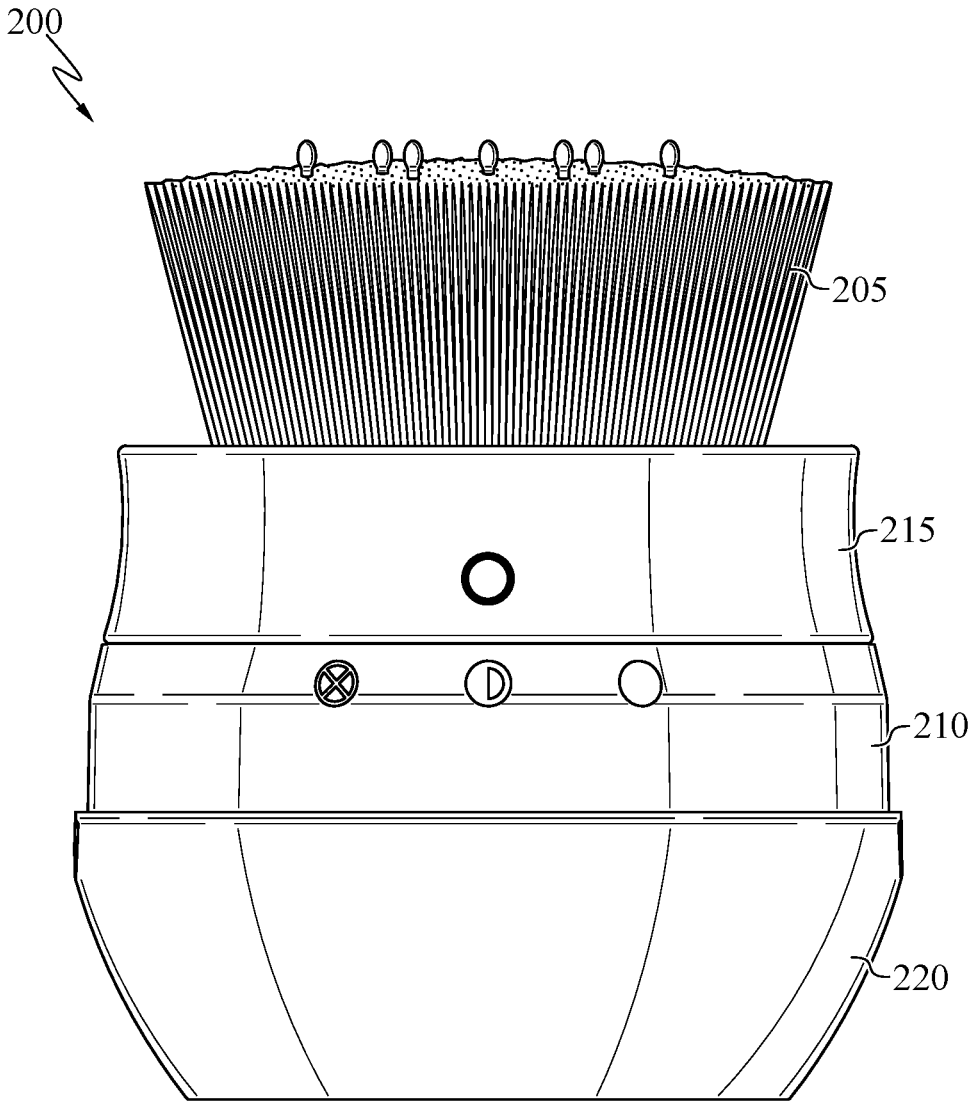
FIG. 2A illustrates a hairbrush applicator with a container according to one or more embodiments.

FIG. 2A illustrates a hairbrush applicator with a container according to one or more embodiments. FIG. 2A shows a front view of hairbrush applicator 200 (e.g., hairbrush applicator 100) including bristle assembly 205, applicator base 210, collar 215 and container 220. Hairbrush applicator 200 may include elements similar to those discussed in FIGS. 1A-1C. According to embodiments, container 220 may be secured to applicator base 210 by a mechanical coupling, such as a threaded connection such that applicator base 210 may be twisted on to container 220. Container 220 may include a chamber or reservoir to hold material, such as dry shampoo. According to embodiments, container 220 may be configured to receive a pouch or cartridge including material. Material stored and/or held in container 220 may be applied to bristles of bristle assembly 205 based on a position of collar 215 relative to applicator base 210. According to embodiments, collar 215 may be rotated relative to applicator base 210 from at least a first position (e.g., an off position) to a second position (e.g., an on position). According to embodiments, collar 210 may be rotated from an off position, to a first on position with a light or low flow, and then rotated further to a second position with increased flow (e.g., heavy flow). When collar 215 is rotated to an on position, hairbrush applicator 200 may be inverted and brushed through a user's hair to dispense material, such as dry shampoo to the user's hair.

According to embodiments, hairbrush applicator 200 may include one or more flow control indicators on structural elements, such as applicator base 210 and collar 215. Flow control indicators may include signs, indicators or markings to indicate a position of collar 215 with respect to applicator base 210, where the position indicates if one of more flow holes and channel openings are aligned to dispense material. According to embodiments, applicator base 210 includes markings 211, 212, and 213 and collar 215 includes indicator 216. Alignment of indicator 216 with indicator 211 may indicate a first position, such as a closed position.

Similarly, alignment of indicator 216 with indicator 212 may indicate an intermediate position, such as a light flow setting, and alignment of indicator 216 with indicator 213 may indicate a second position, such as a regular or increased flow position.

Figure 2B:
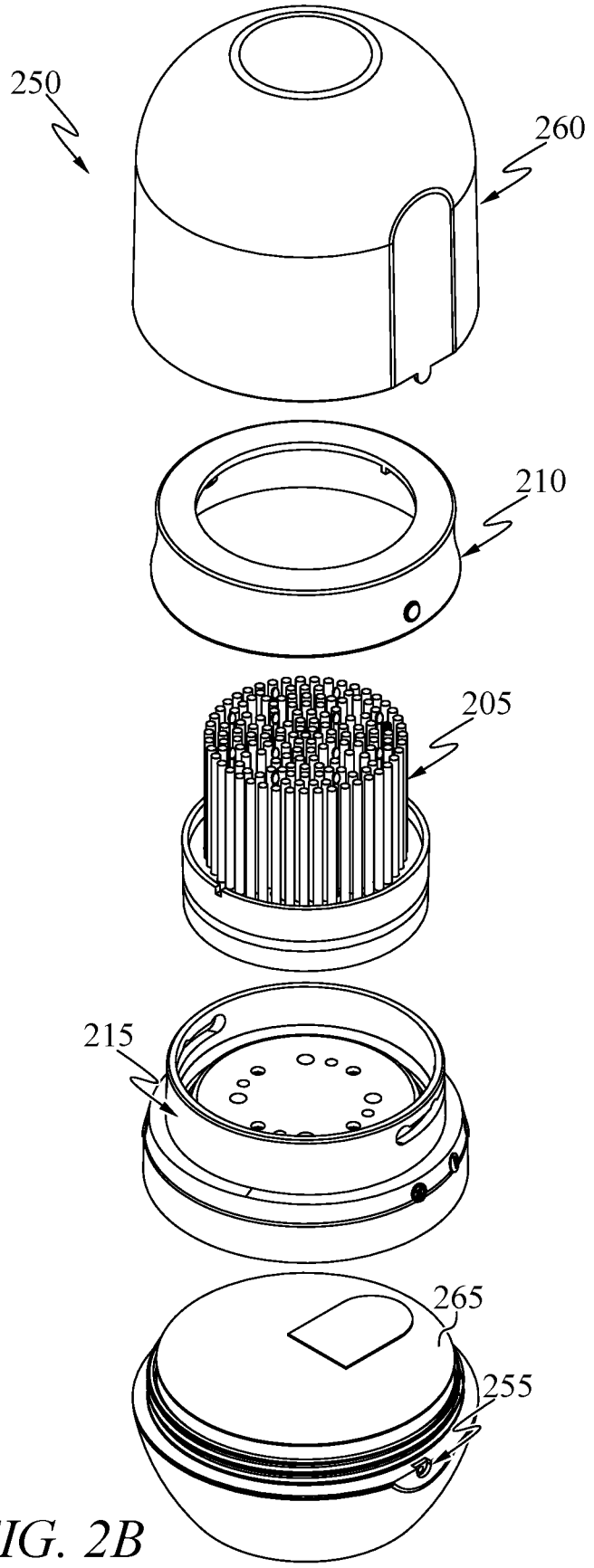
FIG. 2B illustrates an exploded view of a hairbrush applicator with a container according to one or more embodiments.

FIG. 2B illustrates an exploded view of a hairbrush applicator with a container according to one or more embodiments. Configuration 250 illustrates includes hairbrush applicator 200, including bristle assembly 205, applicator base 210, collar 215 and container 220, with a lid 260. According to embodiments, configurations may include lid 260 which may be removably coupled to applicator base 215. Lid 260 may protect bristles of bristle assembly 205. Lid 260 may also prevent leakage of material in the event hairbrush applicator 200 is not stored with collar 210 in a closed position.

As shown in FIG. 2B, an expanded view or disassembled view of hairbrush applicator 200 includes bristle assembly 205 which may be received by applicator base 210. Collar 215 may couple with a rim of applicator base 210 and engage with the rim to securely attach to applicator base 210 and retain bristle assembly 205. Container 220 may include threaded surface to rotatably engage and secure with the underside of applicator base 210. FIG. 2B illustrates container 220 including a grip surface 255. Grip surface 255 may appear on each side of the container 220 to allow for holding hairbrush applicator and as a handle. Container 220 may also be configured to store material, such as dry shampoo and personal care products. Container 220 may be a storage container including a compartment configured to store material dispensed by the hairbrush applicator and/or to store a cartridge of pre-packaged material.

Collar 215 may be configured to engage with a rim of applicator base 210 and collar 215 is configured to engage with the at least one guide channel of applicator base 210. Collar 215 may be configured to rotate relative to applicator base 210 to provide at least a first position and a second position, the second position is configured to arrange the at least one channel opening of a base tray of a bristle assembly and at least one flow hole of a body element of applicator base 210 to dispense material to bristle assembly 205. To couple collar 215, collar 215 includes at least one tab protruding from an inner surface of the collar, the at least one tab configured to engage with the at least one guide channel. Collar 215 may be configured to rotate within the same plane of the at least one guide channel, and a first position of collar 215 may be configured as an off position, an intermediate position of collar 215 may be a first flow setting, and a second position of collar 215 may be a second flow setting. The second flow setting may provide increased flow of material relative to the first position.

Collar 215 may be mounted to applicator base 210 similar to a bayonet mount, wherein a rim of applicator base 210 interfaces with the interior surface or collar 215. One or more radial pins of collar 215 may fit within a guide of applicator base 210 to keep the two parts coupled together. According to embodiments, a body element of applicator base 210 includes a plurality of flow holes having a first opening size, and a plurality of flow holes having a second opening size, wherein the second opening size is greater than the first opening size. The flow holes are each associated with a notch opening for each of the first position and the second position, and slot between the first and the second position.

One aspect of the disclosure is directed to hairbrush elements. In one embodiment, a configuration for a hairbrush element is provided. The hairbrush element is configured for use as a component of a hairbrush. According to one embodiment the hair brush element is configured to apply a product to hair, such as a dry shampoo. Applicator base 210, storage container 220 and collar 215 may form a handle for hairbrush applicator 200, and bristle assembly 205 may be configured to apply at least one of dry shampoo and powder to user hair. Configurations and components discussed herein allow for application of dry shampoo to a hair brush, hair brush applicator, and storage of the hair brush and dry shampoo compartment.

As shown in FIG. 2B, container 220 may retain a cartridge 265 which may be prepackaged. Cartridge 265 may be inserted and removed from container 220 to allow for refilling of material to hairbrush applicator 200 without requiring the user to pour powder or material into container 220. Cartridge 265 may include a removable seal. Storage container 220 may be configured to receive and retain a removable cartridge including the material to dispense to the bristle assembly.

Another aspect of the disclosure is directed to providing alternative products to aerosol shampoo products. In one embodiment, hairbrush applicator configurations are provided as a healthier, more efficient, and environmentally friendly alternative to aerosol dry shampoo. Hairbrush applicator configurations can include one or more elements to apply powder, such as dry shampoo, directly to a bristle assembly. By brushing hair after application of the powder, the powder has minimal contact with the scalp. By using a hairbrush applicator configuration, better scalp and hair separation may be provided in order to coat the hair with the dry shampoo powder more effectively while also stripping away any residue with subsequent brushing. Hairbrush applicator configurations according to embodiments may eliminate the need to spray hair with dry shampoo.

Figure 3A:
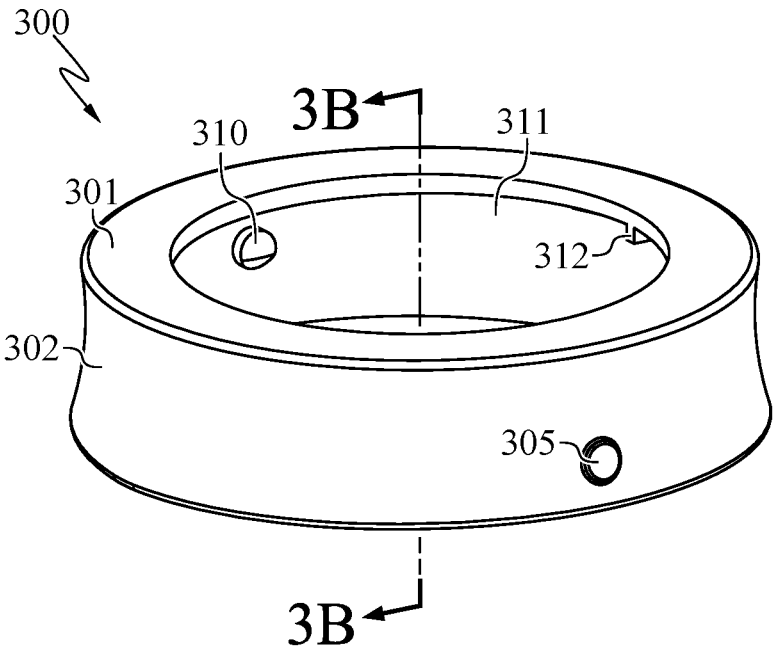
FIGS. 3A-3B illustrate a hairbrush applicator collar according to one or more embodiments.
Figure 3B:
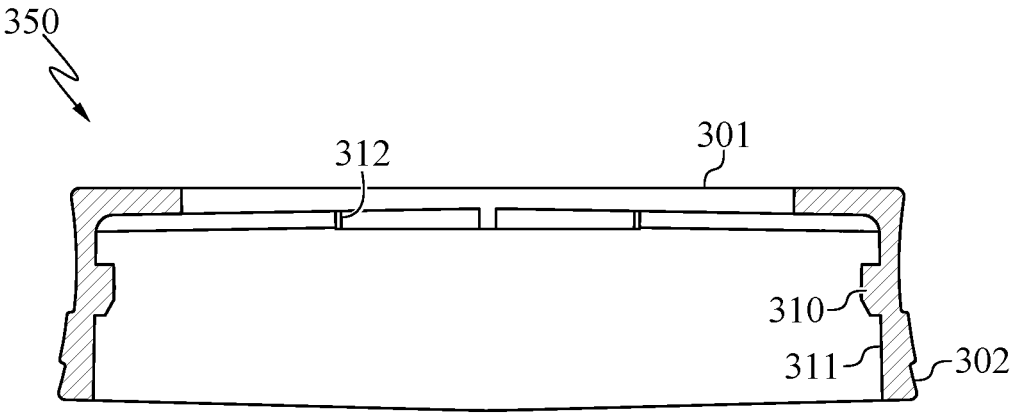

FIGS. 3A-3B illustrate a hairbrush applicator collar according to one or more embodiments. Collar 300 may be configured for a hairbrush applicator (e.g., hairbrush applicator 100, hairbrush applicator 200, etc.). According to embodiments, collar 300 includes a structure having a flattened ring with a top surface 301 and cylindrical wall 302 forming a projecting wall. Structure of collar 300 may be configured to engage with an applicator base (e.g., applicator base 110). According to embodiments, collar 300 may be secured to the applicator base and may adjust the position of a bristle assembly when rotated. According to embodiments, collar includes a flow indicator 305 to indicate the position of collar 300. Flow indicator 305 may be a marking or symbol on an outer surface of cylindrical wall 302. Cylindrical wall 302 may include a flattened edge, and/or may include a curved indentation for gripping collar 300. Interior to cylindrical wall 302 and opposite of flow indicator position 305, collar 300 may include a pair of projections, such as projection 310. Collar 300 may include at least one tab, such as projection 310, protruding from an inner surface of the collar, the at least one tab configured to engage with the at least one guide channel of an applicator base. Projection 310 may include a circular outline and projection of material to engage with a guide channel of an applicator base. According to embodiments, collar 300 includes two projections, opposite from each other. Projection 310 may be located on inner surface 311 of cylindrical wall 302. Structure of collar 300 may include engagement tab 312 extending below top surface 301. Collar 300 may include a pair of engagement tabs, such as engagement tab 312, located on opposite sides of collar 300 and configured to engage with a recess and/or guide element of a bristle assembly. FIG. 3B illustrates a sectional view 350 of collar 300 along the line 3B-3B of FIG. 3A. As shown in FIG. 3B, cylindrical wall 302 including projections 310 on opposite sides extending from inner surface 311. Engagement tab 312 extends down from the top of collar 300.

Projections 310 of collar 300 may be configured to engage with the at least one guide channel of an applicator base. When collar 300 is rotated relative to an applicator base engagement tabs, such as engagement tab 312, the base tray of a bristle assembly is rotated to arrange the at least one channel opening of the base tray and the at least one flow hole of the body element of an applicator base to allow dispensing of material to the bristle assembly. Collar 300 may be configured to rotate within the same plane of the at least one guide channel.

FIGS. 4A-4B illustrate a hairbrush applicator bristle assembly according to one or more embodiments. FIG. 4A illustrates bristle assembly 400 (e.g., bristle assembly 105) including a first set of bristles 405, second set of bristles 406, base tray 410, and support 415. According to embodiments, base tray 410 and support 415 provide structural elements for supporting and retaining bristles. Base tray 410 and support 415 may be joined and/or fixed together. Bristle assembly 400 may include a plurality of bristles secured to the base tray 410, base tray 410 and support 415 each include at least one channel opening.

According to embodiments, base tray 410 includes at least one notch, such as notch 411, configured to receive an engagement tab (e.g., engagement tab 312) of a collar. Base tray 410 may include a pair of notches, each notch configured to receive a protrusion of a collar, such as an engagement tab of a collar, and where rotation of the collar rotates bristle assembly 400 relative to a center axis for alignment of one or more channel openings to flow holds of an applicator base. Rotation of a collar may be configured to rotate bristle assembly 400 to align the at least one channel opening of a bristle assembly with the at least one flow hole of an applicator base.

FIG. 4B illustrates an exploded view of bristle assembly 400. Bristle assembly 400 may include a plurality of bristles including a first set of bristles 405 including an arrangement of fiber elements, and a second set of bristles 406 including a plurality of bristles each having a shaft 407 and molded tip 408. Bristles 406 may each include a base, such as base 409 for mounting to at least one of base tray 410 and support 415. By providing at least two types of bristles, first set of bristles 405 may be configured to distribute and evenly apply material, such as a dry shampoo and second set of bristles 406 may arrange and/or brush hair.

According to embodiments, first set of bristles 405 may be a set of fibers, set of hairs, and/or set of brush elements, wherein the base of the bristles 405 is grafted to base tray 410. Grafting of bristles 405 to base tray 410 may allow for spacing between bristle bases. The spacing may allow for material to exit base tray, allow for other elements to be placed in proximity to the bristles, such as bristles 406, and also improve manufacturing. Grafting of bristles 405 to base tray 410 may reduce the manufacturing time of bristle assembly 400. Base tray 410 may be a structure made of plastic or other molded material include a plurality of openings, including channel openings 412 for material and bristle openings 413. Bristle openings 413 may allow for pass through and/or mounting of bristles 406 through base tray 410. One or more bristle openings 413 may be used for grafting bristles 405 to base tray. Bristles 405 may be arranged in one or more bunches or groups and bases of the groups may be fused to openings in base tray 410. Base tray 410 may receive bristles 406 mounted from an underside of base tray 410 and through openings 413. Support 415 may be formed of plastic, materials and general or molded of material to receive and secure a plurality of bristles, such as bristles 406 and to receive base tray 410. Support 415 may include a plurality of openings 416 which correspond to channel opening positions of base tray 410. Support 415 may include a plurality of projections 417 to interface with and/or retain base tray 410. Projections 417 may extend into base tray 410. Underside 418 of support 415 may receive material, such as dry shampoo powder, to pass through openings 416. Underside 418 may interface and/or rest on a body support of an applicator base and allow rotation.

According to embodiments, the configuration of bristle assembly 400 allows for improvements in manufacturing. A manufacturing process may include grafting bristles to base tray 410, inserting bristles 406 to base tray 410, and coupling support 415 to base tray 410 to form a bristle assembly.

Figure 5A:
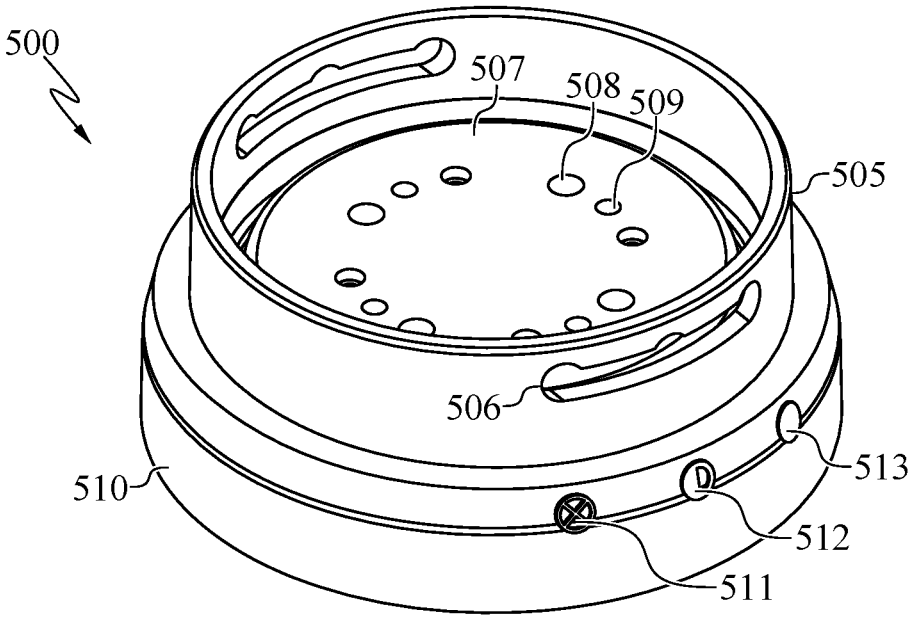
FIGS. 5A-5C illustrate an applicator base of a hairbrush applicator according to one or more embodiments.
Figure 5B:
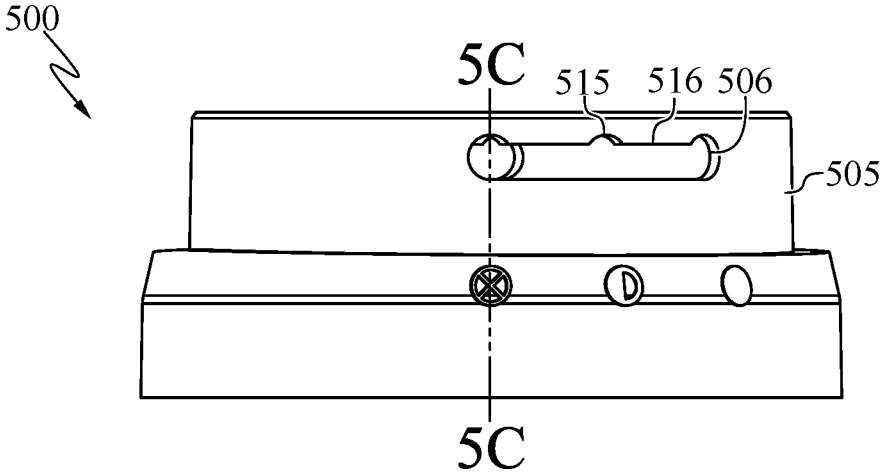
Figure 5C:
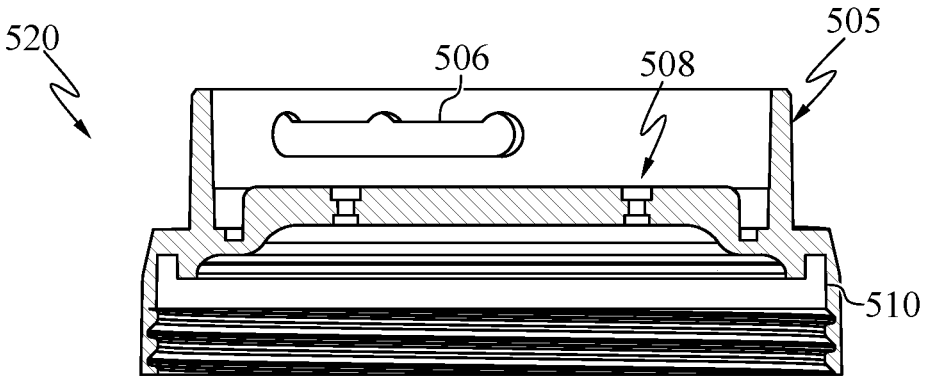

FIGS. 5A-5C illustrate an applicator base of a hairbrush applicator according to one or more embodiments. FIG. 5A illustrates applicator base 500 including body element 505 and rim 510. Body elements 505 may be configured to interface with a container. Body element may also include structure, such as surface 507, to allow for receiving a bristle assembly. According to embodiments body element 505 includes at least one flow hole to provide material to the bristle assembly. Body element 505 may include flow holes of different sizes, and a pattern of flow holes, such that flow holes align with a position of channel openings in a bristle assembly when a collar is rotated. By way of example, body element 505 of the applicator base includes a plurality of flow holes having a first opening size, and a plurality of flow holes having a second opening size, wherein the second opening size is greater than the first opening size. FIG. 5A illustrates flow holes 508 and 509, with flow hole 508 larger than flow hole 509. Applicator base 500 includes rim 510 including at least one guide channel, such as guide channel 506. According to embodiments, applicator base 500 may include a guide channel 506 on each side of body 505. Applicator base 500 includes a notch opening for each of a first position and a second position and a slot between the first and the second position.

FIG. 5B illustrates a side view of applicator base 500. Guide channel 506 is shown including a plurality of notches 515 and a channel 516. FIG. 5B illustrates three notches in guide channel 506. According to embodiments, a projection on an inner surface of a collar (e.g., projection 310) may be positioned in a notch to arrange a bristle assembly and align flow holes with channel openings or to arrange the bristle assembly in an off position. Notches in guide channel 506 may correlate to a first position (e.g., off position), intermediate position (e.g., light flow) and second position (e.g., regular flow). Notches in guide channel may be indicated by flow indicators, such as indicator 511 for the first position, indicator 512 for an intermediate position and indicator 513 for a second position.

FIG. 5C illustrates a sectional view 520 of applicator base 500 along the line 5C-5C of FIG. 5B. As shown in FIG. 5C, applicator base 500 may include a channel guide 506 on each side of rim 510 of body element 505. Flow opening 508 allows for an opening of to the underside of applicator base 500.

Figure 6A:
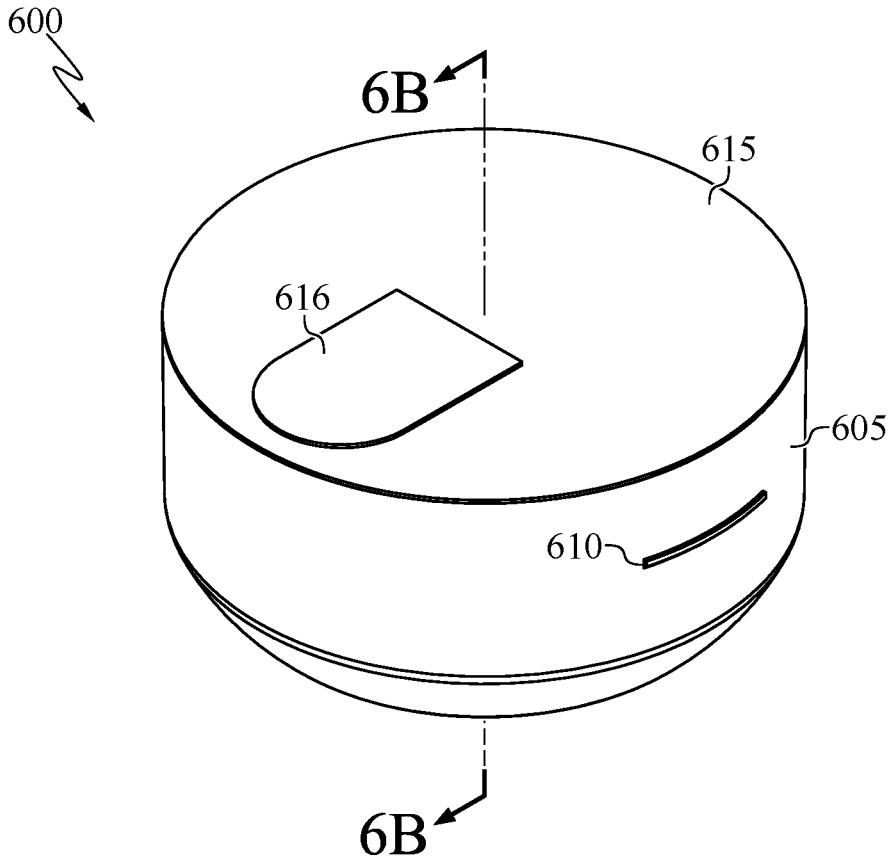
FIGS. 6A-6B illustrate a material cartridge according to one or more embodiments.
Figure 6B:
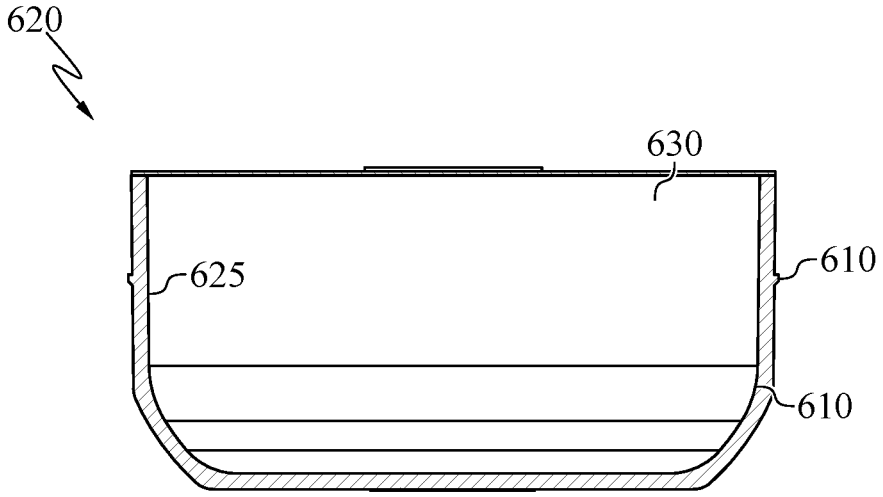

FIGS. 6A-6B illustrate a material cartridge according to one or more embodiments. According to embodiments a hair brush applicator may be configured to receive one or more cartridges, pouches and containers of material. Using replaceable cartridges may allow for an applicator to be reused and may allow for a user to refill a container and reduce waste and/or spillage. According to embodiments, hairbrush applicators may receive a cartridge or pre-packaged refill, such as cartridge 600. Cartridge 600 may include a sidewall 605 configured to engage with the interior of a container (e.g., container 220). According to embodiments, sidewall 605 may include an indentation 610 to retain cartridge 600 within a container of a hairbrush applicator. According to embodiments, cartridge 600 may include seal 615 to provide a leakage protection seal. Seal 615 may include flap 616 to provide an opening in seal 615. Seal 615 may be removable from cartridge 600.

FIG. 6B illustrates a sectional view 620 of cartridge 600 along 6B-6B of FIG. 6A. According to embodiments, cartridge includes compartment 625 to store material 630, which may include dry shampoo and/or other personal care products.

While this disclosure has been particularly shown and described with references to exemplary embodiments thereof, it will be understood by those skilled in the art that various changes in form and details may be made therein without departing from the scope of the claimed embodiments.

What is claimed is:

1. A hairbrush applicator comprising:

a bristle assembly including a plurality of bristles and a base tray, wherein the plurality of bristles are secured to the base tray, and wherein the base tray includes at least one channel opening;

an applicator base configured to receive the bristle assembly, the applicator base including a body element having at least one flow hole, wherein the at least one flow hole is configured to provide material to the bristle assembly, wherein the applicator base includes a rim including at least one guide channel; and a collar configured to engage with the rim, wherein the collar is configured to engage with the at least one guide channel, wherein the collar is configured to rotate relative to the applicator base to provide at least a first position and a second position, wherein the second position is configured to arrange the at least one channel opening of the base tray and the at least one flow hole of the body element to dispense material to the bristle assembly, and wherein the applicator base includes a notch opening for each of the first position and the second position, and a slot between the first and the second position.

2. The hairbrush applicator of claim 1, wherein the plurality of bristles includes a first set of bristles including an arrangement of fiber elements, and a second set of bristles including a plurality of bristles each having a shaft and molded tip.

3. The hairbrush applicator of claim 1, wherein the plurality of bristles are grafted to the base tray.

4. The hairbrush applicator of claim 1, wherein the collar includes at least one tab protruding from an inner surface of the collar, the at least one tab configured to engage with the at least one guide channel.

5. The hairbrush applicator of claim 1, wherein the base tray of the bristle assembly includes at least one notch and the collar includes at least one protrusion configured to engage with the at least one notch of the base tray, and wherein the collar is configured to rotate the bristle assembly to align the at least one channel opening with the at least one flow hole.

6. The hairbrush applicator of claim 1, wherein the collar is configured to rotate within the same plane of the at least one guide channel, wherein the first position is configured as an off position, an intermediate position of the collar is a first flow setting, and the second position of the collar is a second flow setting, wherein the second flow setting provides increased flow of material relative to the first position.

7. The hairbrush applicator of claim 1, wherein the body element of the applicator base includes a plurality of flow holes having a first opening size, and a plurality of flow holes having a second opening size, wherein the second opening size is greater than the first opening size.

8. The hairbrush applicator of claim 1, wherein the applicator base is configured to engage with a storage container, the storage container including a compartment configured to store material dispensed by the hairbrush applicator.

9. The hairbrush applicator of claim 1, wherein the applicator base and collar form a handle for the hairbrush applicator, and the bristle assembly is configured to apply at least one of dry shampoo and powder to user hair.

10. A hairbrush applicator comprising:

a bristle assembly including a plurality of bristles and a base tray, wherein the plurality of bristles are secured to the base tray, and wherein the base tray includes at least one channel opening;

a storage container including a compartment configured to store material dispensed by the hairbrush applicator;

an applicator base configured to receive the bristle assembly, the applicator base including a body element having at least one flow hole, wherein the at least one flow hole is configured to provide material to the bristle assembly, wherein the applicator base includes a rim including at least one guide channel; and a collar configured to engage with the rim, wherein the collar is configured to engage with the at least one guide channel, wherein the collar is configured to rotate relative to the applicator base to provide at least a first position and a second position, wherein the second position is configured to arrange the at least one channel opening of the base tray and the at least one flow hole of the body element to dispense material to the bristle assembly, and wherein the applicator base includes a notch opening for each of the first position and the second position, and a slot between the first and the second position.

11. The hairbrush applicator of claim 10, wherein the plurality of bristles includes a first set of bristles including an arrangement of fiber elements, and a second set of bristles including a plurality of bristles each having a shaft and molded tip.

12. The hairbrush applicator of claim 10, wherein the plurality of bristles are grafted to the base tray.

13. The hairbrush applicator of claim 10, wherein the collar includes at least one tab protruding from an inner surface of the collar, the at least one tab configured to engage with the at least one guide channel.

14. The hairbrush applicator of claim 10, wherein the base tray of the bristle assembly includes at least one notch and the collar includes at least one protrusion configured to engage with the at least one notch of the base tray, and wherein the collar is configured to rotate the bristle assembly to align the at least one channel opening with the at least one flow hole.

15. The hairbrush applicator of claim 10, wherein the collar is configured to rotate within the same plane of the at least one guide channel, wherein the first position is configured as an off position, an intermediate position of the collar is a first flow setting, and the second position of the collar is a second flow setting, wherein the second flow setting provides increased flow of material relative to the first position.

16. The hairbrush applicator of claim 10, wherein the body element of the applicator base includes a plurality of flow holes having a first opening size, and a plurality of flow holes having a second opening size, wherein the second opening size is greater than the first opening size.

17. The hairbrush applicator of claim 10, wherein the applicator base, storage container and collar form a handle for the hairbrush applicator, and the bristle assembly is configured to apply at least one of dry shampoo and powder to user hair.

18. The hairbrush applicator of claim 10, wherein the storage container is configured to receive and retain a removable cartridge including the material to dispense to the bristle assembly.

19. A hairbrush applicator comprising:

a bristle assembly including a plurality of bristles and a base tray, wherein the plurality of bristles are secured to the base tray, and wherein the base tray includes at least one channel opening;

an applicator base configured to receive the bristle assembly, the applicator base including a body element having at least one flow hole, wherein the at least one flow hole is configured to provide material to the bristle assembly, and wherein the applicator base includes a rim including at least one guide channel; and a collar configured to engage with the rim, wherein the collar is configured to engage with the at least one guide channel, wherein the collar is configured to rotate within a same plane of the at least one guide channel and relative to the applicator base to provide at least a first position and a second position, wherein the at least one guide channel includes a first notch, a second notch and a third notch, wherein the first position correlates with the first notch and the second position correlates to the second notch, and wherein the second position is configured to arrange the at least one channel opening of the base tray and the at least one flow hole of the body element to dispense material to the bristle assembly.

* * * * *